US005259994A

United States Patent [19]

Welch et al.

[11] Patent Number: 5,259,994

[45] Date of Patent: Nov. 9, 1993

[54] PARTICULATE LAUNDRY DETERGENT COMPOSITIONS WITH POLYVINYL PYROLLIDONE

[75] Inventors: Robert G. Welch, Cincinnati; Laurie A. K. Bebout, Fairfield, both of Ohio

[73] Assignee: The Procter & Gamble Company, Cincinnati, Ohio

[21] Appl. No.: 924,114

[22] Filed: Aug. 3, 1992

[51] Int. Cl.[5] ..... C11D 3/28; C11D 3/37; C11D 11/00; C11D 17/06

[52] U.S. Cl. ..... 252/542; 252/174.14; 252/174.19; 252/174.21; 252/174.23; 252/174.25; 252/524; 252/DIG. 2; 252/DIG. 15

[58] Field of Search ..... 252/542, 174.25, 174.21, 252/174.19, 174.14, DIG. 15, 174.23, 524, DIG. 2

[56] References Cited

U.S. PATENT DOCUMENTS

| | | | |
|---|---|---|---|
| 3,629,951 | 12/1971 | Davis et al. | 34/33 |
| 3,629,955 | 12/1971 | Davis et al. | 34/174 |
| 3,849,327 | 11/1974 | DiSalvo et al. | 252/109 |
| 3,868,336 | 2/1975 | Mazzola et al. | 252/527 |
| 3,932,295 | 1/1976 | Fujino et al. | 252/102 |
| 4,006,092 | 2/1977 | Jones | 252/95 |
| 4,126,561 | 11/1978 | Barker | 252/8.6 |
| 4,252,656 | 2/1981 | Leibowitz et al. | 252/8.8 |
| 4,298,490 | 11/1981 | Lange et al. | 252/91 |
| 4,309,316 | 1/1982 | Lange et al. | 252/543 |
| 4,414,130 | 11/1983 | Cheng | 252/140 |
| 4,427,567 | 1/1984 | Benz | 252/116 |
| 4,648,882 | 3/1987 | Osberghaus et al. | 8/142 |
| 4,652,392 | 3/1987 | Baginski et al. | 252/109 |
| 4,756,849 | 7/1988 | Weber et al. | 252/542 |
| 4,764,289 | 8/1988 | Trinh | 252/8.6 |
| 4,954,292 | 9/1990 | Hull et al. | 252/542 |
| 4,963,226 | 10/1990 | Chamberlain | 159/48.1 |
| 4,970,017 | 11/1990 | Nakamura et al. | 252/174.13 |
| 5,015,513 | 5/1991 | Newbold et al. | 428/35.5 |
| 5,045,238 | 9/1991 | Jolicoeur et al. | 252/550 |
| 5,077,047 | 12/1991 | Biss et al. | 535/387 |
| 5,108,646 | 4/1992 | Beerse et al. | 252/174.25 |
| 5,164,108 | 11/1992 | Appel et al. | 252/174 |
| 5,178,798 | 1/1993 | Jolicoeur | 252/553 |

FOREIGN PATENT DOCUMENTS

| | | |
|---|---|---|
| 256696 | 2/1988 | European Pat. Off. . |
| 265257 | 4/1988 | European Pat. Off. . |
| 312277 | 4/1989 | European Pat. Off. . |
| 320219 | 6/1989 | European Pat. Off. . |
| 382464 | 8/1990 | European Pat. Off. . |
| 462806A2 | 6/1991 | European Pat. Off. . |
| 477974 | 4/1992 | European Pat. Off. . |
| 3519012 | 11/1986 | Fed. Rep. of Germany . |
| 3840056 | 5/1990 | Fed. Rep. of Germany . |
| 49-093676 | 9/1974 | Japan . |
| 55-003468 | 1/1980 | Japan . |
| 61-028596A | 1/1984 | Japan . |
| 60-142916 | 7/1985 | Japan . |
| 59-006299A | 2/1986 | Japan . |
| 61-291693 | 12/1986 | Japan . |
| 63-245497A | 10/1988 | Japan . |
| 3-111497 | 5/1991 | Japan . |
| 2137221A | 10/1984 | United Kingdom . |

OTHER PUBLICATIONS

PVP: A Critical Review of the Kinetics and Toxicology of Polyvinylpyrrolidone (Povidone), B. V. Robinson, F. M. Sullivan, J. F. Borzelleca and S. L. Schwartz, pp. 1-21, Lewis Publishers, Inc., Chelsea, Mich. (1990).

"PVP (Polyvinylpyrrolidone)", GAF Chemicals Corporation, Wayne, N.J. (1990).

*Primary Examiner*—Paul Lieberman
*Assistant Examiner*—A. Hertzog
*Attorney, Agent, or Firm*—Ken K. Patel; Ronald L. Hemingway; Jacobus C. Rasser

[57] ABSTRACT

A detergent additive for inclusion in a particulate, free-flowing laundry detergent composition comprising polyvinyl pyrrolidone, finely divided powder, hydrating salt, and binding agent is presented. A process for making a particulate, free-flowing laundry detergent composition is also presented.

17 Claims, No Drawings

PARTICULATE LAUNDRY DETERGENT COMPOSITIONS WITH POLYVINYL PYROLLIDONE

TECHNICAL FIELD

The present invention relates to a detergent additive for inclusion in a particulate, free-flowing laundry detergent composition, comprising: polyvinyl pyrrolidone of molecular weight from about 1,000 to about 100,000, finely divided powder having a particle size of less than about 20 microns, hydrating salt, and binding agent.

Also included is a process for making a free-flowing, particulate laundry detergent composition, comprising forming a detergent additive by mixing the PVP, finely divided powder and hydrating salt, and spraying on the binding agent, and then admixing the additive with detergent particles.

BACKGROUND OF THE INVENTION

Polyvinyl pyrrolidone (PVP) is a desirable laundry detergent ingredient because it: (a) inhibits dye transfer in the wash, thus protecting fabric colors; (b) scavenges chlorine from the wash water, thus reducing fabric bleaching by chlorine-containing wash water; and (c) prevents soils released from the washed fabrics from being redeposited on the fabric during the wash. However, it has been found that simply admixing PVP into a granular laundry detergent composition, particularly one containing citric acid, can cause flow problems and lumping and caking over time when the detergent composition is exposed to humid conditions. In the extreme case, the sticky PVP can cause the detergent composition to form into a brick-like mass inside the detergent carton.

It has now been found that this negative effect from admixing PVP into the detergent composition is reduced or eliminated through use of the present PVP additive.

Another advantage of this additive involves reducing the problems associated with handling PVP itself in bulk. Bulk quantities of the additive will tend to cake less and flow better than PVP by itself. It is thus more easily handled.

U.S. Pat. No. 3,868,336, Mazzola et al, issued Feb. 25, 1975, discloses a process for improving flowability of particulate detergents which include an oily detergent improver using a porous or finely divided flow-promoting agent.

U.S. Pat. No. 3,849,327,DiSalvo et al, issued Nov. 19, 1974, discloses the manufacture of a free-flowing particulate heavy duty synthetic detergent composition containing nonionic surfactant and anti-redeposition agent which can be polyvinyl alcohol or polyvinyl pyrrolidone.

SUMMARY OF THE INVENTION

The present invention relates to a detergent additive for inclusion in a particulate, free-flowing laundry detergent composition comprising, by weight of the additive:

(a) from about 15% to about 60% of polyvinyl pyrrolidone with molecular weight from about 1,000 to about 100,000;

(b) from about 5% to about 90% of a finely divided powder having a particle size of less than about 20 microns;

(c) from about 5% to about 60% of a hydrating salt; and (d) from about 0.5% to about 30% of a binding agent.

Also included is a process for making a free-flowing, particulate laundry detergent composition, comprising:

(1) forming a detergent additive by mixing, by weight of the additive:

(a) from about 15% to about 60% of polyvinyl pyrrolidone with molecular weight from about 1,000 to about 100,000;

(b) from about 5% to about 90% of a finely divided powder having a particle size of less than about 20 microns; and (c) from about 5% to about 60% of a hydrating salt; spraying on from about 0.5% to about 30% of a binding agent; and (2) admixing from about 0.1% to about 25% of the particulate detergent additive with from about 99.9% to about 75% of the detergent particles.

DETAILED DESCRIPTION OF THE INVENTION

The present invention is a detergent additive for inclusion in a free-flowing, particulate laundry detergent composition, comprising polyvinyl pyrrolidone, finely divided powder, hydrating salt and binding agent. The additive is preferably also particulate and free-flowing. The ingredients are described below.

Also included is a process for making a free-flowing, particulate laundry detergent composition, comprising forming a detergent additive by mixing PVP, finely divided powder, and hydrating salt, spraying on the binding agent, and then admixing the additive with detergent particles.

Polyvinyl Pyrrolidone

The present detergent additive for inclusion in a free-flowing, particulate laundry detergent composition comprises, by weight of the additive, from about 15% to about 60%, preferably from about 20% to about 50%, most preferably from 25% to 30%, of polyvinyl pyrrolidone with a molecular weight of from about 1,000 to about 100,000, preferably from about 3,000 to about 50,000, more preferably from 5,000 to 30,000, most preferably from 8,000 to 15,000. By "molecular weight" is meant "viscosity average molecular weight", with "K-value" between about 10 and about 34, most preferably between 13 and 19.

PVP in the laundry detergent compositions herein can act as an anti-redeposition agent, a dye transfer inhibitor, and a fabric color protectant. However, simply admixing PVP into a particulate laundry detergent composition can cause flow problems and lumping and caking over time with exposure to a humid environment.

Without meaning to be bound by theory, it is believed that PVP, which is hygroscopic, picks up moisture from the humid air and causes the detergent particles to stick together, thus impeding flow. Further it is believed that PVP-caused stickiness unacceptably increases lumping and caking of the finished detergent product by increasing the force needed to break apart granules bonded by the sticky PVP.

Substituted and unsubstituted vinyl pyrrolidone polymerization products are included herein. Generally, the higher the molecular weight of the PVP is, the less PVP is needed. Polyvinyl alcohol is preferably not included in the detergent additive and/or the finished detergent compositions herein.

Most preferred is PVP K-15 (ISP) with a viscosity average molecular weight of 10,000 and a K-value of 13–19.

Finely Divided Powder

The present detergent additive also comprises, by weight of the additive, from about 5% to about 90%, preferably from about 10% to about 80%, most preferably from 20% to 30%, of a finely divided powder having a particle size of less than about 20 microns, preferably between about 0.1 microns and about 15 microns, most preferably between 1 micron and 10 microns.

By "particle size" is meant average or mean particle size diameter as determined by conventional analytical techniques such as Malvern analysis.

Without meaning to be bound by theory, it is believed that this finely divided powder prevents moisture pick up by the PVP from the air. When the PVP becomes sticky from moisture, the finely divided powder adheres to its surface, preventing interaction between the PVP and the detergent composition.

Preferred finely divided powders herein are selected from the group consisting of calcium carbonate, layered silicate, fumed silica, sodium aluminosilicate, talc, powdered sodium pyrophosphate, and mixtures thereof. More preferred are calcium carbonate, talc, and/or sodium aluminosilicate. Most preferred are calcium carbonate and sodium aluminosilicate, each with a particle size between about 2 microns and about 10 microns.

Preferred aluminosilicates are water-insoluble crystalline or amorphous aluminosilicate ion exchange materials. Preferred aluminosilicates have the formula:

$$M_z(zAlO_2 \cdot ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Aluminosilicates useful herein are commercially available and can be naturally occurring, but are preferably synthetically derived. A method for producing aluminosilicates is discussed in U.S. Pat. No. 3,985,669. Preferred synthetic crystalline aluminosilicate ion exchange materials herein are available under the designation Zeolite A, X, B, and/or HS. Zeolite A is particularly preferred.

Another suitable finely divided powder is layered silicate. Preferred is a crystalline layered sodium silicate (Na2Si2O5), which is available as SKS-6 from Hoechst. Suitable aluminosilicates and red silicates for use herein are as described in U.S. Pat. No. 5,108,646, Beerse et al, issued Apr. 28, 1992, incorporated herein by reference.

Hydrating Salt

The present detergent additive (which is preferably a "premix") further comprises, by weight of the additive, from about 5% to about 60%, preferably from about 10% to about 50%, most preferably from 20% to 40%, of a hydrating salt. This is preferably selected from the group consisting of the alkali metal salts of carbonate, sulfate, tripolyphosphate, citrate, and mixtures thereof. Sodium (preferred), potassium, or ammonium salts are preferred. By "hydrating salt" is meant alkali metal salts capable of forming one or multiple hydrates over a wide temperature range.

The particle size of the hydrating salts is not limited to small size (eg less than about 20 microns) like the finely divided powder. Preferred are sodium carbonate and sodium sulfate. Preferred particle size (average or mean particle diameter) is from about 1 micron to about 500 microns, most preferably from about 50 microns to about 200 microns.

The preferred ratio of hydrating salt to finely divided powder is from about 1:3 to about 3:1, most preferably about 1:1.

Without meaning to be bound by theory, it is believed that the hydrating salt provides a moisture sink within close proximity to the PVP; therefore, upon exposure of the additive to atmospheric moisture, the salt will first bind the free moisture. In the event the PVP still picks up moisture, it is believed that the finely divided powder will cool the sticky PVP, minimizing interaction with the detergent composition.

Binding Agent

The detergent additive herein further includes, by weight of the additive, from about 0.5% to about 30%, preferably from about 1% to about 20%, most preferably from 3% to 6%, of a binding agent.

The binding agent is preferably selected from the group consisting of nonionic surfactant (preferred), anionic surfactant, water soluble polymers, and mixtures thereof.

Suitable anionic surfactants and water-soluble polymers are as described in U.S. Pat. No. 5,108,646, Beerse et al, issued Apr. 28, 1992, columns 4–7, incorporated herein by reference.

Most preferred are:

(1) an anionic synthetic surfactant paste or mixtures thereof with ethoxylated nonionic surfactants where the weight ratio of said anionic surfactant paste to ethoxylated nonionic surfactant is at least about 3:1; or (2) a water-soluble polymer containing at least about 50% by weight of ethylene oxide or mixtures thereof with ethoxylated nonionic surfactant where the weight ratio of said polymer to ethoxylated nonionic surfactant is at least about 1:1.

The binding agent provides a means to adhere the PVP, finely divided powder, and hydrating salt. It is believed that maintaining the three powders in proximity upon addition to the detergent composition is important herein. This is facilitated by the premixing of the additive ingredients.

The preferred binding agent is a water-soluble nonionic surfactant. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Semi-polar nonionic surfactants include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80.

Particularly preferred is a condensation product Of $C_{12}$–$C_{15}$ alcohol with from about 2 to about 20 moles of ethylene oxide per mole of alcohol, e.g., $C_{12}$–$C_{13}$ alcohol condensed with about 6.5 moles of ethylene oxide per mole of alcohol.

The preferred ratio of nonionic surfactant to finely divided powder is from about 1:15 to about 1:2, preferably from about 1:7 to about 1:4.

Preferably no additional ingredients are added to the detergent additive, which is preferably free-flowing, particulate and without phosphate.

Process

Also included herein is a process for making a free-flowing, particulate laundry detergent composition, comprising forming a detergent additive by mixing the PVP, finely divided powder, and hydrating salt herein, spraying on the binding agent, and then admixing the additive with detergent particles.

Included herein is a process for making a free-flowing, particulate laundry detergent composition, comprising:

(1) forming a detergent additive by mixing, by weight of the additive:
   (a) from about 5% to about 60% of polyvinyl pyrrolidone with molecular weight from about 1,000 to about 100,000;
   (b) from about 5% to about 90% of a finely divided powder having a particle size of less than about 20 microns; and
   (c) from about 5% to about 60% of a hydrating salt; and spraying on from about 0.5% to about 30% of a binding agent; and
(2) admixing from about 0.1% to about 25% of the detergent additive with from about 99.9% to about 75% of the detergent particles.

Mixing is preferably in a: 1) shear mixer (eg kneader, muller), 2) mixer with horizontal movement (eg ribbon mixer, pug mill), 3) turbulent mixer (eg Lodige or Eirich type mixer, pin mixer), 4) high intensity mixer (eg Schugi), or 5) tumble mixer (eg Munson mixer, V-Blender). Preferably, step (1) mixing takes place in a mixer selected from the group consisting of: 1) shear mixers, 2) mixers with horizontal movement, 3) turbulent mixers, 4) high intensity mixers, and 5) tumble mixers.

More preferably, mixing is in a turbulent mixer, most preferably a Lodige mixer, or a high intensity mixer, most preferably a Schugi mixer.

Preferably, the order of addition to a batch mixer (e.g. Eirich type mixer) is: powders, most preferably PVP, finely divided powder, and then hydrating salt; followed by liquids, most preferably the binding agent. In a continuous mixer such as a Schugi, the preferred order of addition is: liquids, most preferably the binding agent, being added at the same time that the powders are being added to the mixer.

The detergent additive is then admixed with the detergent particles, preferably on a conveying belt, most preferably in a rotating tumble mixer. Preferably the order of addition is the detergent particles followed by the additive. Most preferably, the additive is added before any other detergent admixes (such as perfumes, dedusting agents, builders and enzymes).

Detergent particles can be prepared by conventional spray drying methods or by agglomeration, most preferably by spray drying. An appropriate agglomeration process is described in U.S. Pat. No. 5,108,646, V, Beerse et al, issued Apr. 28, 1992, incorporated herein by reference. Appropriate spray drying processes are as described in U.S. Pat. Nos. 4,963,226, Chamberlain, issued Oct.16, 1990, and U.S. Pat. Nos. 3,629,951 and 3,629,955, both Davis et al, issued Dec.28, 1971. These three are incorporated herein by reference.

Detergent Composition

Any conventional granular laundry detergent ingredients can be included herein. Suitable ingredients for use herein are described in U.S. Pat. Nos. 5,108,646 (see above); 5,045,238, Jolicoeur et al, issued Sep. 3, 1991; and 5,066,425, Ofosu-Asante et al, issued Nov. 19, 1991, all incorporated herein by reference.

The detergent particles which are admixed with the detergent additive preferably comprise, by weight of the detergent particles: from about 1% to about 90% of detergency surfactant, more preferably from about 5% to about 50% of anionic surfactant, most preferably from about 15% to about 30% of sodium alkylbenzene sulfonate and sodium alkylsulfate; from 0 to about 90%, preferably from about 10% to about 70%, of detergency builders, preferably sodium aluminosilicate, sodium silicate, sodium sulfate, and/or sodium carbonate; from about 1% to about 8% of sodium polyacrylate of molecular weight from about 2,000 to about 8,000; from about 0.5% to about 8% of polyethylene glycol of molecular weight from about 4,000 to about 10,000; and from about 0.001% to about 1% of optical brighteners/fluorescent whitening agents.

Additional ingredients are preferably admixed with the detergent particles after the detergent additive. These are preferably from about 1% to about 15% of citric acid, from about 0.5% to about 8% of ammonium sulfate, from about 0.001% to about 1% of protease and/or other enzymes such as amylase, lipase and cellulase, from about 0.01% to about 1% of perfume, and from about 0.001% to about 1% of suds suppressor. The suds suppressor is preferably as described in U.S. Pat. No. 4,652,392, Baginski et al, issued Mar. 24, 1987, which is incorporated herein by reference.

Also included herein is a free-flowing, particulate laundry detergent composition, preferably without phosphate, comprising the above described additive. The free-flowing, particulate laundry detergent composition preferably comprises the additive herein, which is preferably free-flowing and particulate, and from about 1% to about 15%, preferably 5% to 7%, of citric acid. The free-flowing, particulate laundry detergent composition preferably comprises from about 0.1% to about 25%, preferably from about 1% to about 15%, of the additive and from about 99.9% to about 75%, preferably from about 99% to about 85%, of the detergent particles.

More preferably, the finished detergent composition comprises from about 2% to about 6% of the detergent additive, from about 97% to about 79% of the detergent particles, and from about 1% to about 15% of citric acid or other additional ingredients, such as perfumes, dedusting agents, enzymes and/or builders. These can be admixed with the detergent particles before or after (preferably) the premix has been added.

The following examples are given to illustrate the parameters of and compositions within the invention. All percentages, parts and ratios are by weight unless otherwise indicated.

EXAMPLES I-III

Particulate laundry detergent compositions are made as follows. "Base Product" is compared to "PVP Control" for % bulk density loss, cake strength, and compression below. First, a Detergent Base is made by spray drying an aqueous slurry of the following components.

| Detergent Base | Percent By Weight |
|---|---|
| Sodium $C_{12}$ alkylbenzenesulfonate | 13.8 |
| Sodium $C_{14-15}$ alkylsulfate | 6.0 |
| Sodium aluminosilicate (Zeolite A) | 27.7 |
| Sodium silicate solids (1.6R) | 2.4 |
| Sodium sulfate | 29.0 |
| Sodium polyacrylate (MW 4500) | 3.6 |
| Optical brighteners | 0.3 |
| Sodium carbonate | 6.2 |
| Polyethylene glycol (MW 8000) | 1.6 |
| Moisture | 8.8 |
| Miscellaneous inert matter | Balance |

Additional ingredients are admixed with the Detergent Base in a rotating drum as follows.

| | Base Product Percent by Weight | PVP Control Percent by Weight |
|---|---|---|
| Detergent Base | 91.62 | 90.62 |
| Citric acid | 5.0 | 5.0 |
| Ammonium sulfate | 2.0 | 2.0 |
| Protease/amylase (57 Au/g/ 20,000 KNu/g | 0.9 | 0.9 |
| Perfume | 0.34 | 0.34 |
| Suds suppressor* | 0.14 | 0.14 |
| Polyvinyl pyrrolidone | 0 | 1.0 |

*5% silicone in polyethylene glycol per U.S. Pat. No. 4,652,392.

EXAMPLE I

Both products are packed in lined cardboard containers and placed for 1 week, 4 weeks and 8 weeks in a room which cycles daily between 70° F. (21.1° C.) and 90° F. (32.2° C.) and between 40% and 80% humidity. At the end of each period, physical properties of the products are evaluated (see below).

"PVP Control" has significant losses in bulk density and physical properties (i.e. Cake Strength and Compression) overall.

Since most detergent products come with a dosing device (e.g. scoop), this bulk density loss translates to a performance loss. When using a dosing device, the lower bulk density can result in lower than target dosages. Lumping and caking negatively impact the consumer's impression of the detergent product. For cake grades of 10.0 and above, the product is difficult to scoop. In comparison, "Base Product" does not have the loss in bulk density or physical properties seen for "PVP Control".

| | % Density Loss | | Cake Strength | | Compression | |
|---|---|---|---|---|---|---|
| | Base Product | PVP Control | Base Product | PVP Control | Base Product | PVP Control |
| Initial | 0 | 0 | 7.8 lbf | 7.8 lbf | 10 mm | 10 mm |
| 1 week | 0 | 2.7% | 6.6 lbf | 9.0 lbf | 11 mm | 12 mm |
| 4 weeks | 4.6% | 13.0% | 7.6 lbf | 11.8 lbf | 15 mm | 20 mm |
| 8 weeks | 5.3% | 9.4% | 9.0 lbf | 12.0 lbf | 15 mm | 19 mm |

Cake Strength—force required to break compressed cylinder of detergent composition. 0 is best, ≧10 is judged unacceptable after 4 weeks.

Compression—measure of height change when the detergent composition is subjected to a downward force in a fixed cylindrical chamber. 0 is best, maximum is typically 2.0.

EXAMPLE II

"Base Product" and "PVP Control" are packed in lined cardboard containers and placed in a constant temperature/humidity room for 1 week, 4 weeks and 8 weeks. Room temperature is held at 80° F. (26.6° C.) and humidity is held at 60% humidity. As in Example I, "PVP Control" has losses in density and physical properties (i.e. Cake Strength and Compression) overall.

| | % Density Loss | | Cake Strength | | Compression | |
|---|---|---|---|---|---|---|
| | Base Product | PVP Control | Base Product | PVP Control | Base Product | PVP Control |
| Initial | 0 | 0 | 7.8 lbf | 7.8 lbf | 10 mm | 10 mm |
| 1 week | 0 | 0 | 5.6 lbf | 5.6 lbf | 10 mm | 10 mm |
| 4 weeks | 1.0% | 2.7% | 6.0 lbf | 8.8 lbf | 10 mm | 12 mm |
| 8 weeks | 4.6% | 7.7% | 8.0 lbf | 9.0 lbf | 12 mm | 15 mm |

EXAMPLE III

"Base Product" and "PVP Control" are packed in lined cardboard containers and placed in the same room used for Example II. In this case, the products are pulled at 1 week, 2 weeks and 4 weeks. Both products used in this test are prepared using new lots of raw materials. The results from this test confirm the trends observed in Examples I and II.

| | % Density Loss | | Cake Strength | | Compression | |
|---|---|---|---|---|---|---|
| | Base Product | PVP Control | Base Product | PVP Control | Base Product | PVP Control |
| Initial | 0 | 0 | 4.8 lbf | 3.5 lbf | 5 mm | 4 mm |
| 1 week | 4.5% | 6.0% | 7.2 lbf | 7.2 lbf | 8 mm | 8 mm |
| 2 weeks | 14.4% | 16.4% | 8.5 lbf | 9.0 lbf | 10 mm | 10 mm |

-continued

| | % Density Loss | | Cake Strength | | Compression | |
|---|---|---|---|---|---|---|
| | Base Product | PVP Control | Base Product | PVP Control | Base Product | PVP Control |
| 4 weeks | 15.9% | 20.1% | 7.5 lbf. | 10.0 lbf | 13 mm | 18 mm |

Conclusion: As shown in Examples I–III, admixing polyvinyl pyrrolidone into these detergent compositions compromises flow, bulk density and lump/cake properties of the finished product upon storage in warm, humid conditions.

EXAMPLE IV

Results from a 4-week storage stability test comparing "PVP Control" to "PVP Premix" (the additive of the present invention) are below. "PVP Premix" is prepared by mixing 4% polyvinyl pyrrolidone additive as described below with 96% of the Base Product described in Example I. This composition results in the same level of PVP in finished product for both "PVP Control" and "PVP Premix". Listed below are density loss, cake strength and compression results.

| PVP Premix | |
|---|---|
| Polyvinyl pyrrolidone (MW 10,000) | 25% |
| Sodium carbonate | 55% |
| Sodium aluminosilicate (Zeolite A) | 15% |
| Nonionic surfactant* | 5% |

*$C_{12-13}$ alcohol ethoxylated with 6.5 moles of ethylene oxide per mole of alcohol.

"PVP Premix" is made by mixing PVP, carbonate, and aluminosilicate in an Eirich mixer followed by spray-on of the nonionic surfactant.

| | Detergent Base | PVP Control Product | PVP Premix Product |
|---|---|---|---|
| | % Density Loss vs Time | | |
| Initial | 0 | 0 | 0 |
| 1 week | 4.5% | 6.0% | 1.7% |
| 2 weeks | 14.4% | 16.4% | 13.2% |
| 4 weeks | 15.9% | 20.1% | 14.2% |
| | Cake Strength vs Time | | |
| Initial | 4.8 | 3.5 | 5.0 |
| 1 week | 7.2 | 7.2 | 7.2 |
| 2 weeks | 8.5 | 9.0 | 9.0 |
| 4 weeks | 7.5 | 10.0 | 8.1 |
| | Compression (millimeters) vs. Time | | |
| Initial | 0.5 | 0.4 | 0.6 |
| 1 week | 0.8 | 0.8 | 0.7 |
| 2 weeks | 1.0 | 1.0 | 1.0 |
| 4 weeks | 1.3 | 1.8 | 1.1 |

Conclusion: The PVP premix eliminates the flow (% density loss) and lump/cake negative impact of admixed PVP.

EXAMPLES V–VIII

The "PVP Premix" (additive) of Example IV can be varied as follows:

| | Example V | Example VI |
|---|---|---|
| Polyvinyl pyrrolidone (MW 10,000) | 25% | 25% |
| Sodium carbonate | 35% | 15% |
| Sodium aluminosilicate (Zeolite A) | 35% | 55% |
| Nonionic surfactant* | 5% | 5% |

*$C_{12-13}$ alcohol ethoxylated with 6.5 moles of ethylene oxide per mole of alcohol.

-continued

| | Example VII | Example VIII |
|---|---|---|
| Polyvinyl pyrrolidone | 25% | 25% |
| Sodium sulfate | 35% | 15% |
| Sodium aluminosilicate | 35% | 55% |
| Anionic surfactant* | 5% | 5% |

*Sodium $C_{12}$ alkylbenzenesulfonate

EXAMPLE IX

Particulate, free-flowing laundry detergent compositions with or without PVP premix are described below.

| PVP Premix | |
|---|---|
| Polyvinyl pyrrolidone | 25% |
| Sodium carbonate | 35% |
| Sodium aluminosilicate (Zeolite A) | 35% |
| Nonionic surfactant* | 5% |

*$C_{12-13}$ alcohol ethoxylated with 6.5 moles of ethylene oxide per mole of alcohol.

The above "PVP Premix" is made as in Example IV. It has a ratio of hydrating agent to finely divided powder of 1:1.

A Detergent Base having the following composition is spray dried.

| Detergent Base | Percent by Weight |
|---|---|
| Sodium $C_{12}$ alkylbenzenesulfonate | 15.9 |
| Sodium $C_{14-15}$ alkylsulfate | 4.5 |
| Sodium alkylethoxy sulfate (E 1.0) | 2.3 |
| Sodium aluminosilicate (Zeolite A) | 31.7 |
| Sodium silicate solids (1.6R) | 2.8 |
| Sodium sulfate | 12.5 |
| Sodium polyacrylate (MW 4500) | 4.1 |
| Optical brighteners | 0.4 |
| Sodium carbonate | 11.4 |
| Polyethylene glycol (MW 8000) | 2.1 |
| Moisture | 11.8 |
| Miscellaneous inert matter | Balance |

To the spray dried particles of the Detergent Base in a rotating drum, additional ingredients are admixed as follows:

| | Base Product Percent by Weight | PVP Premix Control Percent by Weight |
|---|---|---|
| Detergent Base | 90.22 | 86.2 |
| Citric acid | 7.0 | 7.0 |
| Sodium perborate monohydrate | 1.0 | 1.0 |
| Protease/amylase (57 Au/g/ 20,000 KNu/G | 0.9 | 0.9 |
| Lipase (5,000,000 Lu/g) | 0.2 | 0.2 |
| Cellulase (430,000 CEUu/g) | 0.6 | 0.6 |
| Silicone suds suppressor | 0.1 | 0.1 |
| PVP additive (see Example V) | 0.0 | 4.0 |
| Total | 100.0 | 100.0 |

Both products are packed in lined cardboard containers and placed in a constant temperature/humidity room for 1 week, 2 weeks and 4 weeks. Room temperature/humidity are held at 80° F. (26.6° C.)/60% humidity.

| | % Density Loss | | Cake Strength | | Compression | |
|---|---|---|---|---|---|---|
| | Base Product | PVP Control | Base Product | PVP Control | Base Product | PVP Control |
| Initial | 0 | 0 | 6.7 lbf | 5.9 lbf | 5 mm | 5 mm |
| 1 week | 7.4% | 2.7% | 9.6 lbf | 8.1 lbf | 9 mm | 7 mm |
| 4 weeks | 6.1% | 4.4% | 9.0 lbf | 8.6 lbf | 7 mm | 9 mm |
| 8 weeks | 5.6% | 5.2% | 10.6 lbf | 10.5 lbf | 10 mm | 10 mm |

Conclusion: The data shows that the modified additive (PVP premix) formulation delivers the benefits shown in Example IV. premix prevents the negatives associated with admixing PVP directly to the detergent composition.

What is claimed is:

1. A detergent additive for inclusion in a particulate, free-flowing laundry detergent composition comprising by weight of the additive:

(a) from about 15% to about 60% of polyvinyl pyrrolidone with molecular weight from about 5,000 to about 30,000 and a K value of from about 10 to about 34;

(b) from about 5% to about 90% of a finely divided powder having a particle size of less than about 20 microns selected from the group consisting of calcium carbonate, layered silicate, fumed silica, sodium aluminosilcate, powdered sodium pyrophosphate, talc, and mixtures thereof:

(c) from about 5% to about 60% of a hydrating salt selected from the group consisting of the alkali metal salts of carbonate, sulfate, tripolyphosphate, citrate, and mixtures thereof; and (d) from about 0.5% to about 30% of a binding agent selected from the group consisting of nonionic surfactant, anionic surfactant, water soluble polymer excluding polyvinyl pyrrolidone, and mixtures thereof.

2. A detergent additive according to claim 1 comprising, by weight of the additive;

(a) from about 20% to about 50% of polyvinyl pyrrolidone:

(b) from about 10% to about 80% of the finely divided powder having a particle size of between about 0.1 microns and about 15 microns;

(c) from about 10% to about 50% of the hydrating salt; and (d) from about 1% to about 20% of the binding agent.

3. A detergent additive according to claim 2 comprising, by weight of the additive:

(a) from 25% to 30% of polyvinyl pyrrolidone;

(b) from 20% to 30% of the finely divided powder having a particle size of between 1 micron and 10 microns;

(c) from 20% to 40% of the hydrating salt; and (d) from 3% to 6% of the binding agent.

4. A detergent additive according to claim 1 wherein the finely divided powder is selected from the group consisting of calcium carbonate, talc, and sodium aluminosilicate.

5. A free-flowing, particulate additive according to claim 1 wherein the binding agent is nonionic surfactant and the ratio of binding agent to finely divided powder is from about 1:15 to about 1:2.

6. A detergent additive according to claim 1 wherein the ratio of hydrating salt to finely divided powder is from about 1:3 to about 3:1.

7. A detergent additive according to claim 6 wherein the nonionic surfactant is a condensation product of $C_{12-15}$ alcohol with from about 2 to about 20 moles of ethylene oxide per mole of alcohol.

8. A detergent additive according to claim 7 wherein the ratio nonionic surfactant to finely divided powder is from about 1:7 to about 1:4, the ratio of hydrating salt to finely divided powder is about 1:1, and the hydrating salt has a particle size from about 50 microns to about 200 microns.

9. A free-flowing, particulate laundry detergent composition comprising an additive according to claim 1.

10. A free-flowing, particulate laundry detergent composition without phosphate and comprising from about 0.1% to about 25% of a free-flowing, particulate detergent additive according to claim 1, and from about 99.9% to about 75% of detergent particles.

11. A free-flowing, particulate laundry detergent composition according to claim 9 comprising from about 2% to about 6% of the additive, from about 97% to about 79% of the detergent particles, and from about 1% to about 15% of citric acid.

12. A free-flowing, particulate laundry detergent composition according to claim 9 wherein the detergent particles comprise, by weight of the detergent particles: from about 1% to about 90% of detergency surfactant; from 0 to about 90% of detergency builder; from about 1% to about 8% of sodium polyacrylate of molecular weight from about 2,000 to about 8,000; from about 0.5% to about 8% of polyethylene glycol of molecular weight from about 4,000 to about 10,000; and from about 0.001% to about 1% of optical brighteners.

13. A process for making a free-flowing, particulate laundry detergent composition, comprising, (1) forming a detergent additive by mixing, by weight of the additive:

(a) from about 5% to about 60% of polyvinyl pyrrolidone with molecular weight from about 5,000 to about 30,000 and a K value of from about 10 to about 34;

(b) from about 5% to about 90% of a finely divided powder having a particle size of less than about 20 microns selected from the group consisting of calcium carbonate, layered silicate, fumed silica, sodium aluminosilcate, powdered sodium pyrophosphate, talc, and mixtures thereof, and (c) from about 5% to about 60% of a hydrating salt selected from the group consisting of the alkali metal salts of carbonate, sulfate, tripolyphosphate, citrate, and mixtures thereof, and spraying on from about 0.5% to about 30% of a binding agent selected from the group consisting of nonionic surfactant, anionic surfactant, water soluble polymer excluding polyvinyl pyrrolidone, and mixtures thereof, and (2) admixing from about 0.1% to about 25% of the additive with from about 99.0% to about 75% of detergent patrticles.

14. A process according to claim 13 wherein the detergent particles are made by spray drying.

15. A process according to claim 14 wherein step (2) consists essentially of admixing from about 1% to about 15% of the additive with from about 99% to about 85% of the detergent particles.

16. A process according to claim 13 wherein step (1) mixing takes place in a mixer selected from the group consisting of: 1) shear mixers, 2) mixers with horizontal movement, 3) turbulent mixers 4) high intensity mixers, and 5) tumble mixers.

17. A process according to claim 13 wherein the detergent particles are made by agglomeration.

* * * * *